US008528677B2

(12) United States Patent
Davis et al.

(10) Patent No.: US 8,528,677 B2
(45) Date of Patent: Sep. 10, 2013

(54) WORKING VEHICLE HAVING COOLING SYSTEM

(75) Inventors: Dean E. Davis, Troy, OH (US); Derek M. Gamertsfelder, St. Marys, OH (US); Jason R. Kremer, New Bremen, OH (US); Joerg Nellen, Moers (DE); Nicholas J. Stein, Celina, OH (US)

(73) Assignee: Crown Equipment Corporation, New Bremen, OH (US)

( * ) Notice: Subject to any disclaimer, the term of this patent is extended or adjusted under 35 U.S.C. 154(b) by 530 days.

(21) Appl. No.: 12/708,574

(22) Filed: Feb. 19, 2010

(65) Prior Publication Data

US 2010/0242865 A1 Sep. 30, 2010

Related U.S. Application Data

(60) Provisional application No. 61/163,578, filed on Mar. 26, 2009, provisional application No. 61/163,584, filed on Mar. 26, 2009.

(51) Int. Cl.
*F01P 3/18* (2006.01)

(52) U.S. Cl.
USPC ... 180/68.1; 180/68.4; 180/68.6; 165/104.19; 123/41.19

(58) Field of Classification Search
USPC ..... 180/68.4, 68.6, 68.1, 68.2; 123/41.49, 123/198 E; 165/104.19
See application file for complete search history.

(56) References Cited

U.S. PATENT DOCUMENTS

| | | | | |
|---|---|---|---|---|
| 3,155,473 | A | | 11/1964 | McNeil |
| 3,487,623 | A | | 1/1970 | Easter |
| 3,565,203 | A | | 2/1971 | Ashton |
| 3,630,003 | A | | 12/1971 | Ashton |
| 3,636,684 | A | | 1/1972 | Vogelaar et al. |
| 3,664,129 | A | | 5/1972 | Schwab |
| 3,837,149 | A | | 9/1974 | West et al. |
| 4,060,960 | A | | 12/1977 | Hengen et al. |
| 4,092,942 | A | | 6/1978 | Kurohiji et al. |
| 4,121,683 | A | * | 10/1978 | Kohriyama ..... 180/68.6 |
| 4,153,436 | A | | 5/1979 | Cozine et al. |

(Continued)

FOREIGN PATENT DOCUMENTS

| | | | |
|---|---|---|---|
| DE | 102004059701 | A1 | 6/2006 |
| EP | 0 481 203 | A1 | 4/1992 |

(Continued)

OTHER PUBLICATIONS

Nora Lindner; International Preliminary Report on Patentability and and Written Opinion of the International Searching Authority; International Application No. PCT/US2010/024681; Oct. 6, 2011; International Bureau of WIPO; Geneva Switzerland.

(Continued)

*Primary Examiner* — John Walters
*Assistant Examiner* — Brian Swenson
(74) *Attorney, Agent, or Firm* — Stevens & Showalter LLP

(57) ABSTRACT

A cooling assembly is provided for use in a work vehicle. The cooling assembly may comprise a heat exchanger for transferring energy in the form of heat from a coolant fluid to air passing through the heat exchanger, filter structure positioned adjacent a first side of the heat exchanger to filter the air before the air passes through the heat exchanger, and a fan shroud positioned adjacent a second side of the heat exchanger.

19 Claims, 8 Drawing Sheets

(56) References Cited

U.S. PATENT DOCUMENTS

| | | | | |
|---|---|---|---|---|
| 4,233,040 | A | 11/1980 | Vogelaar et al. | |
| 4,299,603 | A | 11/1981 | Friesen | |
| 4,339,014 | A | 7/1982 | Berth et al. | |
| 4,371,047 | A | 2/1983 | Hale et al. | |
| 4,397,348 | A | 8/1983 | Klem | |
| 4,439,218 | A | 3/1984 | Priepke et al. | |
| 4,443,236 | A | 4/1984 | Peiler | |
| 4,514,201 | A | 4/1985 | Brown | |
| 4,531,574 | A | 7/1985 | Hoch | |
| 4,539,943 | A | 9/1985 | Tsuchikawa et al. | |
| 4,542,785 | A | 9/1985 | Bagnall et al. | |
| 4,546,742 | A | 10/1985 | Sturges | |
| 4,592,437 | A | 6/1986 | Holm et al. | |
| 4,757,858 | A | 7/1988 | Miller et al. | |
| 4,874,411 | A | 10/1989 | Snauwaert et al. | |
| 4,906,262 | A | 3/1990 | Nelson et al. | |
| 4,913,102 | A | 4/1990 | Ohmura et al. | |
| 4,969,533 | A | 11/1990 | Holm et al. | |
| 4,971,525 | A | 11/1990 | Nakayoshi et al. | |
| 5,088,960 | A | 2/1992 | Stickler et al. | |
| 5,183,487 | A | 2/1993 | Lodico et al. | |
| 5,224,446 | A | 7/1993 | Okita et al. | |
| 5,466,189 | A | 11/1995 | Deutsch et al. | |
| 5,531,190 | A | 7/1996 | Mork | |
| 5,595,537 | A | 1/1997 | Jungermann et al. | |
| 5,676,197 | A | 10/1997 | Diebold et al. | |
| 5,735,337 | A | 4/1998 | Edwards | |
| 5,839,279 | A | 11/1998 | Moriya et al. | |
| 5,851,441 | A | 12/1998 | Kato et al. | |
| 5,944,603 | A | 8/1999 | Guinn et al. | |
| 5,960,748 | A | 10/1999 | Lewis | |
| 5,960,899 | A * | 10/1999 | Roach | 180/68.4 |
| 5,971,068 | A | 10/1999 | Ochiai et al. | |
| 6,010,309 | A | 1/2000 | Takamura et al. | |
| 6,076,488 | A | 6/2000 | Yamagishi | |
| 6,105,660 | A | 8/2000 | Knurr | |
| 6,126,079 | A | 10/2000 | Shoemaker | |
| 6,131,681 | A * | 10/2000 | Nelson et al. | 180/68.1 |
| 6,178,928 | B1 | 1/2001 | Corriveau | |
| 6,193,772 | B1 | 2/2001 | Wiefel | |
| 6,248,145 | B1 | 6/2001 | Radke | |
| 6,298,906 | B1 | 10/2001 | Vize | |
| 6,308,795 | B2 * | 10/2001 | Sewell | 180/68.4 |
| 6,349,882 | B1 | 2/2002 | Kita et al. | |
| 6,432,152 | B2 | 8/2002 | Frerich | |
| 6,467,538 | B1 * | 10/2002 | Acre et al. | 165/266 |
| 6,468,153 | B2 | 10/2002 | Sheidler et al. | |
| 6,481,388 | B1 | 11/2002 | Yamamoto | |
| 6,514,303 | B2 | 2/2003 | Lukac et al. | |
| 6,616,411 | B2 | 9/2003 | Sheidler et al. | |
| 6,634,448 | B2 | 10/2003 | Bland | |
| 6,796,897 | B1 | 9/2004 | Lovett et al. | |
| 6,817,404 | B2 | 11/2004 | Frana-Guthrie et al. | |
| 6,823,955 | B2 | 11/2004 | Hall et al. | |
| 6,959,671 | B2 | 11/2005 | Nakagawa et al. | |
| 6,974,487 | B2 | 12/2005 | Twiefel | |
| 7,204,329 | B2 * | 4/2007 | Pfohl et al. | 180/68.3 |
| 7,401,672 | B2 * | 7/2008 | Kurtz et al. | 180/68.4 |
| 7,481,287 | B2 * | 1/2009 | Madson et al. | 180/68.1 |
| 7,503,380 | B2 | 3/2009 | Jakob | |
| 8,020,655 | B2 * | 9/2011 | Robinson | 180/68.1 |
| 8,104,559 | B2 * | 1/2012 | Kisse | 180/68.1 |
| 8,256,551 | B2 * | 9/2012 | Entriken et al. | 180/68.1 |
| 2003/0183433 | A1 * | 10/2003 | MacKelvie | 180/68.1 |
| 2005/0051308 | A1 | 3/2005 | Jakob | |
| 2005/0217907 | A1 | 10/2005 | Madson et al. | |
| 2006/0283157 | A1 | 12/2006 | Keys, II et al. | |
| 2007/0056786 | A1 * | 3/2007 | Fukazawa et al. | 180/89.12 |
| 2007/0261908 | A1 | 11/2007 | Berger et al. | |
| 2008/0169142 | A1 * | 7/2008 | Kinoshita et al. | 180/68.1 |

FOREIGN PATENT DOCUMENTS

| | | | |
|---|---|---|---|
| EP | 0 667 447 | A1 | 8/1995 |
| EP | 1 493 905 | A1 | 1/2005 |
| JP | 52138151 | U | 10/1977 |
| JP | 53099434 | U | 8/1978 |
| JP | 57083229 | U | 5/1982 |
| JP | 60170029 | U | 11/1985 |
| JP | 61058631 | U | 4/1986 |
| JP | 4100918 | U | 9/1992 |
| JP | 08 049540 | | 2/1996 |
| JP | 09 009760 | | 1/1997 |
| JP | 2001263063 | A | 9/2001 |
| JP | 2003314283 | A | 11/2003 |

OTHER PUBLICATIONS

Lingfei Bai; International Preliminary Report on Patentability and and Written Opinion of the International Searching Authority; International Application No. PCT/US2010/024714; Oct. 6, 2011; International Bureau of WIPO; Geneva Switzerland.

U.S. Appl. No. 12/708,625, filed Feb. 19, 2010 entitled "Working Vehicle Having Cooling System With Suction Device".

Application No. PCT/US10/24681, filed Feb. 19, 2010 entitled "Working Vehicle Having Cooling System".

Application No. PCT/US10/24714, filed Feb. 19, 2010 entitled "Working Vehicle Having Cooling System With Suction Device".

J. Matray; International Search Report and Written Opinion of the International Searching Authority; International Application No. PCT/US2010/024714; Apr. 28, 2010; European Patent Office.

J. Matray; International Search Report and Written Opinion of the International Searching Authority; International Application No. PCT/US2010/024681; Jun. 21, 2010; European Patent Office.

Hawkins, Karla; Non-final Office Action; U.S. Appl. No. 12/708,625; Jul. 30, 2012; U.S. Patent and Trademark Office; Alexandria, VA.

Karla Hawkins; Final Office Action in U.S. Appl. No. 12/708,625; Dec. 21, 2012; U.S. Patent and Trademark Office; Alexandria, VA.

* cited by examiner

WORKING VEHICLE HAVING COOLING SYSTEM

CROSS REFERENCE TO RELATED APPLICATIONS

This application claims the benefit of U.S. Provisional Patent Application Ser. No. 61/163,578, filed Mar. 26, 2009, entitled "WORKING VEHICLE HAVING COOLING SYSTEM," and U.S. Provisional Patent Application Ser. No. 61/163,584, filed Mar. 26, 2009, entitled "WORKING VEHICLE HAVING COOLING SYSTEM WITH SUCTION DEVICE," the entire disclosures of each of which are hereby incorporated by reference herein. This application is related to International Application No. PCT/US2010/024681, filed concurrently herewith, and entitled "WORKING VEHICLE HAVING COOLING SYSTEM," the entire disclosure of which is hereby incorporated by reference herein. This application is related to U.S. Application Ser. No. 12/708,625, filed concurrently herewith, and entitled "WORKING VEHICLE HAVING COOLING SYSTEM WITH SUCTION DEVICE," the entire disclosure of which is hereby incorporated by reference herein.

BACKGROUND OF THE INVENTION

The present invention relates in general to working vehicles, and more particularly, to cooling systems in working vehicles.

U.S. Pat. No. 3,636,684 discloses a harvesting machine having a fan 72 which pulls air into an engine enclosure 50 through screens, wherein the air passes through a radiator core 56 prior to exiting the enclosure 50, see column 5, lines 54-59.

U.S. Pat. No. 3,664,129 discloses a lift truck including "a hydraulic motor-driven cooling fan, the speed of which is varied with engine temperature," see column 1, lines 42-44 and column 3, lines 15-20. "The fan blades draw engine-heated air rearwardly through radiator core 18 and push such air through air duct 28 and out through the rear end of the truck," see column 3, lines 20-22.

U.S. Pat. No. 6,959,671 discloses a cooling system for a work vehicle wherein a "rotational speed of the cooling fan 13 actuated by the hydraulic pump 18 is continuously controlled according to the temperature of the coolant, the temperature of the hydraulic oil and the rotational speed of the engine," see column 5, lines 3-7. The '671 patent also teaches that the direction of the fan may be reversed such that "dust or the like caught in the radiator 12 is blown off by a reverse current of air," see column 5, lines 24-30.

SUMMARY OF THE INVENTION

In accordance with a first aspect of the present invention, a work vehicle is provided comprising a main frame including an engine compartment; an engine located in the engine compartment; and a cooling system for removing energy in the form of heat from the engine and transferring that energy to air. The cooling system may comprise a rotating fan apparatus and a cooling assembly. The cooling assembly may comprise a heat exchanger and a filter structure. The heat exchanger may transfer energy in the form of heat from a coolant fluid circulating through the engine to air forced through the heat exchanger by the fan apparatus. The filter structure may be positioned adjacent a first side of the heat exchanger to filter the air before the air passes through the heat exchanger and comprise a support frame and at least one filter element held by the support frame. The support frame may maintain the filter element at an angle relative to vertical.

The filter element may comprise a mesh screen.

An upper portion of the filter element may be spaced a first distance away from the heat exchanger and a lower portion of the filter element may be spaced a second distance away from the heat exchanger, with the first distance being greater than the second distance.

The fan apparatus may comprise a fan and a motor. The motor may effect rotation of the fan in a first direction to pull air from the engine compartment through the heat exchanger to remove heat from the coolant fluid. The fan motor may be capable of reversing direction so as to effect rotation of the fan in a second direction to force air through the filter element to force debris off of the filter element.

In accordance with a second aspect of the present invention, a cooling assembly is provided for use in a work vehicle. The cooling assembly may comprise a heat exchanger for transferring energy in the form of heat from a coolant fluid to air passing through the heat exchanger, filter structure positioned adjacent a first side of the heat exchanger to filter the air before the air passes through the heat exchanger, first seal structure located between the filter structure and the heat exchanger to seal an interface between the filter structure and the heat exchanger, a fan shroud positioned adjacent a second side of the heat exchanger, and a second seal structure located between the heat exchanger and the fan shroud.

The cooling assembly may further comprise connecting structure to couple together the filter structure, the first seal structure, the heat exchanger, the fan shroud and the second seal structure.

The connecting structure may comprise at least one spacer provided with a bore, a bolt passing through the spacer bore and a nut. The bolt may extend through corresponding bores in the filter structure and the fan shroud while the spacer is located between the filter structure and the fan shroud.

The filter structure may comprise a support frame and at least one filter element held by the support frame. The filter element may comprise a mesh screen.

The support frame may maintain the filter element at an angle relative to vertical. An upper portion of the filter element may be spaced a first distance away from the heat exchanger and a lower portion of the filter element may be spaced a second distance away from the heat exchanger, with the first distance being greater than the second distance.

The filter structure may further comprise a third seal structure located between the support frame and the filter element.

The cooling assembly may further comprise a main frame seal structure adapted to be located between the fan shroud and a main frame of the work vehicle.

In accordance with a third aspect of the present invention, a work vehicle is provided comprising a main frame including an engine compartment; an engine located in the engine compartment; and a cooling system for removing energy in the form of heat from the engine and transferring that energy to air. The cooling system may comprise a rotating fan apparatus and a cooling assembly. The cooling assembly may comprise: a heat exchanger for transferring energy in the form of heat from a coolant fluid circulating through the engine to air forced through the heat exchanger by the fan apparatus; filter structure positioned adjacent a first side of the heat exchanger to filter the air before the air passes through the heat exchanger; first seal structure located between the filter structure and the heat exchanger to seal an interface between the filter structure and the heat exchanger; a fan shroud positioned adjacent a second side of the heat exchanger; and a second seal structure located between the heat exchanger and the fan shroud.

The cooling assembly may further comprise connecting structure to couple together the filter structure, the first seal structure, the heat exchanger, the fan shroud and the second seal structure.

The cooling assembly may further comprise a main frame seal structure located between the fan shroud and the main frame.

BRIEF DESCRIPTION OF THE SEVERAL VIEWS OF THE DRAWINGS

The following description of the preferred embodiments of the present invention can be best understood when read in conjunction with the following drawings, where like structure is indicated with like reference numerals, and in which.

DETAILED DESCRIPTION OF THE INVENTION

In the following description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
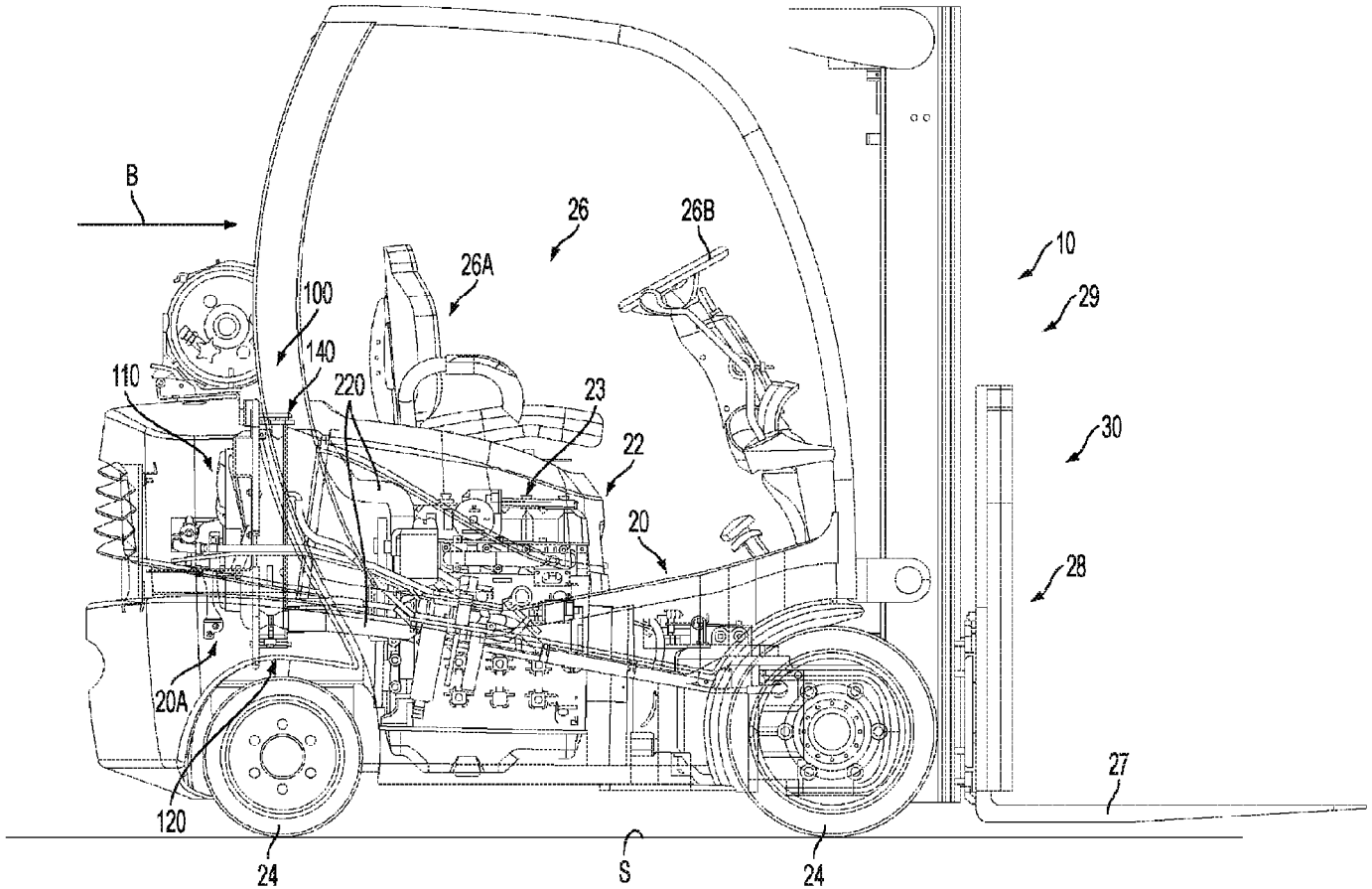
FIG. 1 is a side view of a vehicle including a cooling system constructed in accordance with the present invention.
Figure 2:
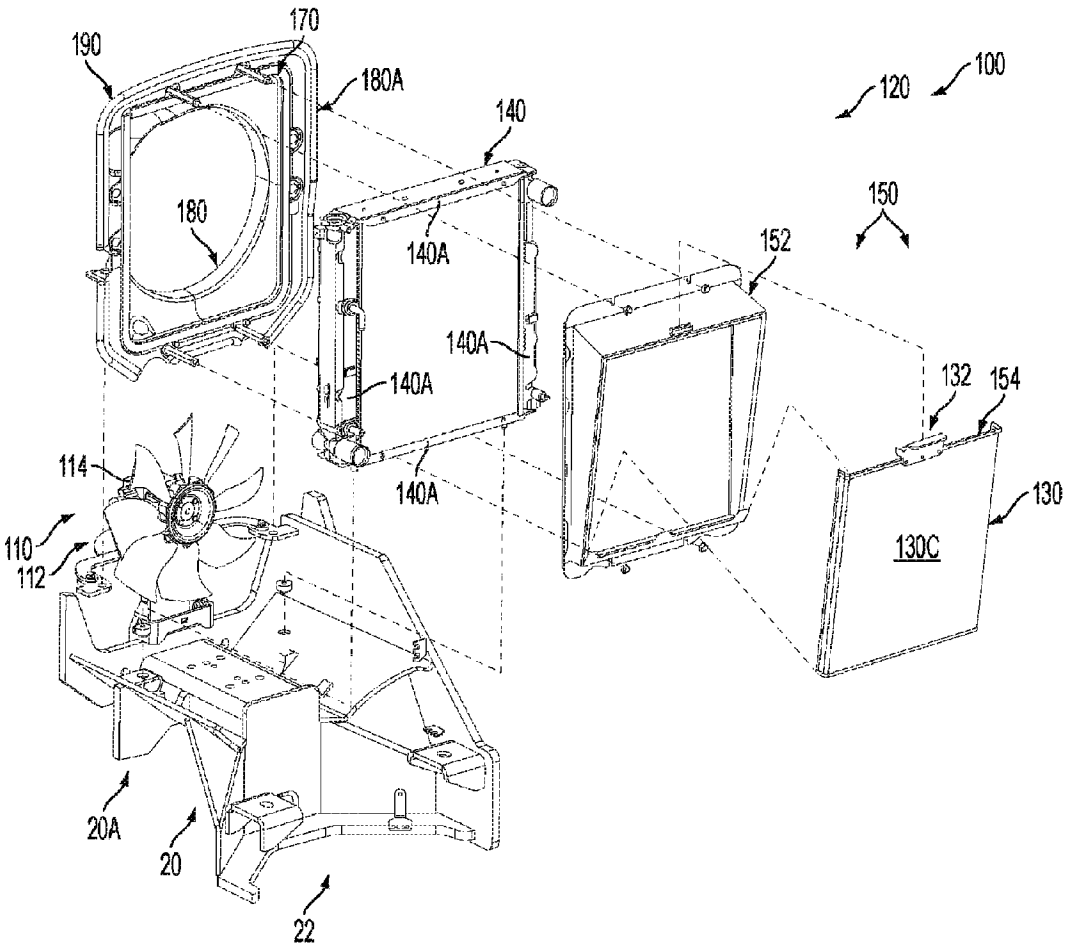
FIGS. 2 and 3 are exploded views including the cooling system illustrated in FIG. 1.
Figure 3:
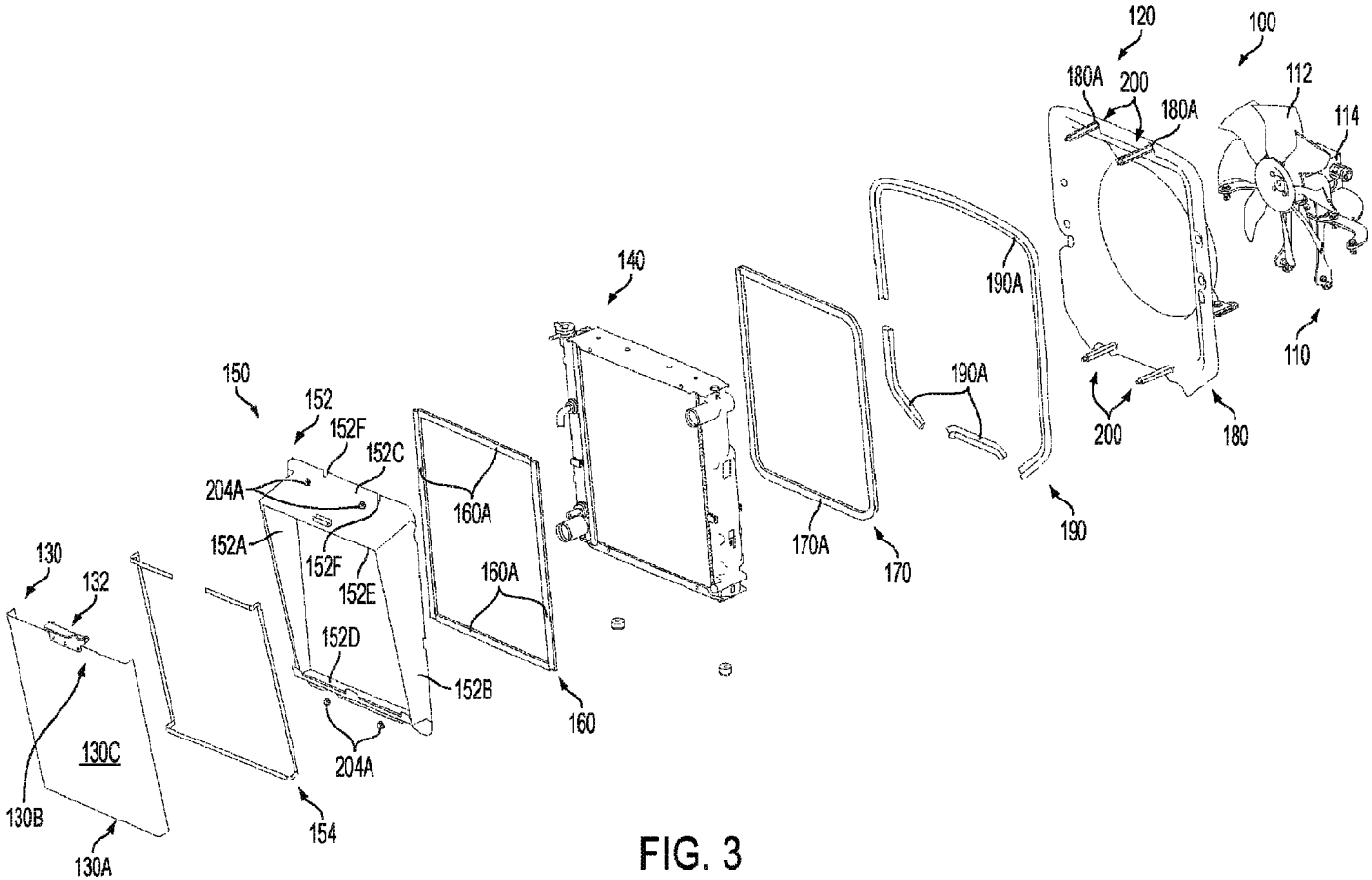
Figure 4:
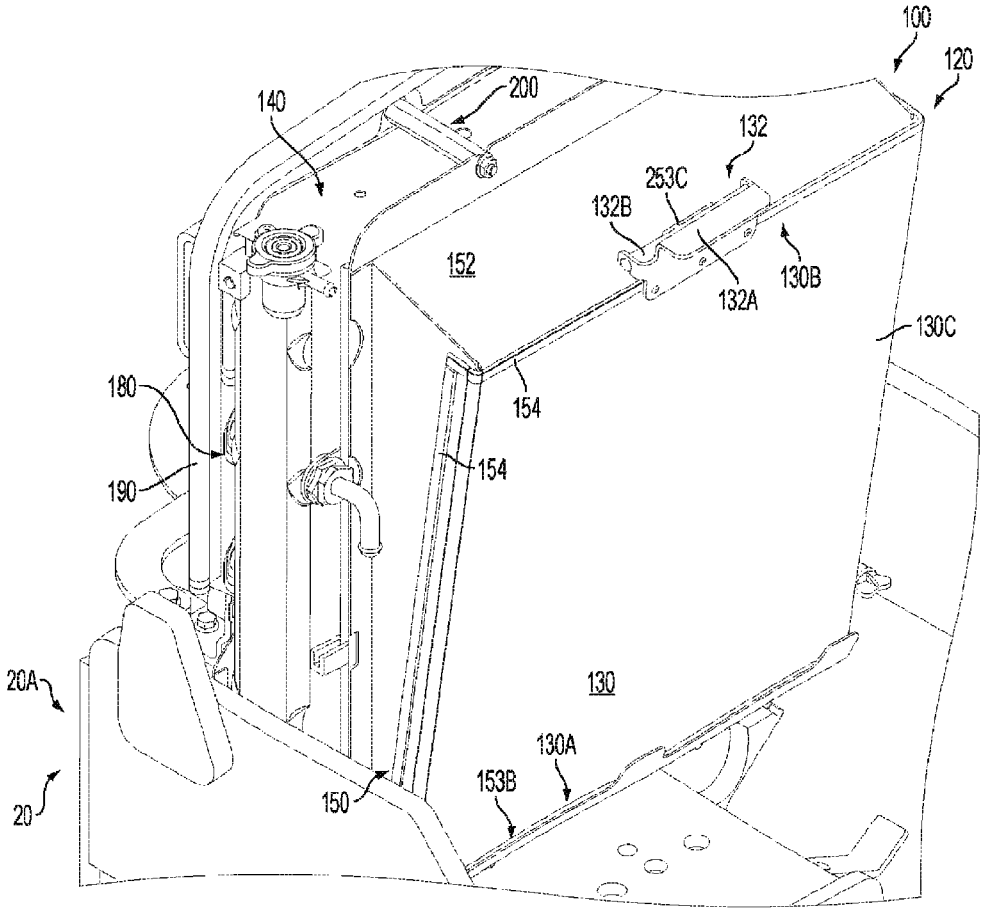
FIG. 4 is a perspective view of the cooling system illustrated in FIG. 1.

Referring now to the drawings, and particularly to FIG. 1, a work vehicle, comprising a materials handling vehicle 10 in the illustrated embodiment, is shown and includes a cooling system 100 constructed in accordance with the present invention, see also FIGS. 2-4. The materials handling vehicle 10 comprises a main frame 20 including an engine compartment 22 housing an internal combustion engine 23 or a hybrid propulsion system (not shown). Four wheels 24 are coupled to the main frame 20. At least one of the wheels 24 is driven and at least one is steerable. The vehicle 10 also includes an operator's compartment 26 including an operator's seat 26A and a steering wheel 26B. A pair of forks 27 are mounted on a fork carriage mechanism 28, which, in turn, is coupled to an extensible mast assembly 29. The forks 27, fork carriage mechanism 28 and mast assembly 29 define a fork assembly 30 coupled to the main frame 20. As will be discussed further below, the cooling system 100 removes energy in the form of heat from the engine 23 and transfers that energy to air. It is contemplated that the cooling system 100 may also be incorporated into other work vehicles, such as a skid steer loader.

In the illustrated embodiment, the cooling system 100 comprises a rotating fan apparatus 110 and a cooling assembly 120, see FIG. 2. Both the fan apparatus 110 and the cooling assembly 120 are mounted to a rear portion 20A of the vehicle main frame 20, see FIGS. 1, 2, 4 and 6.

Figure 5:
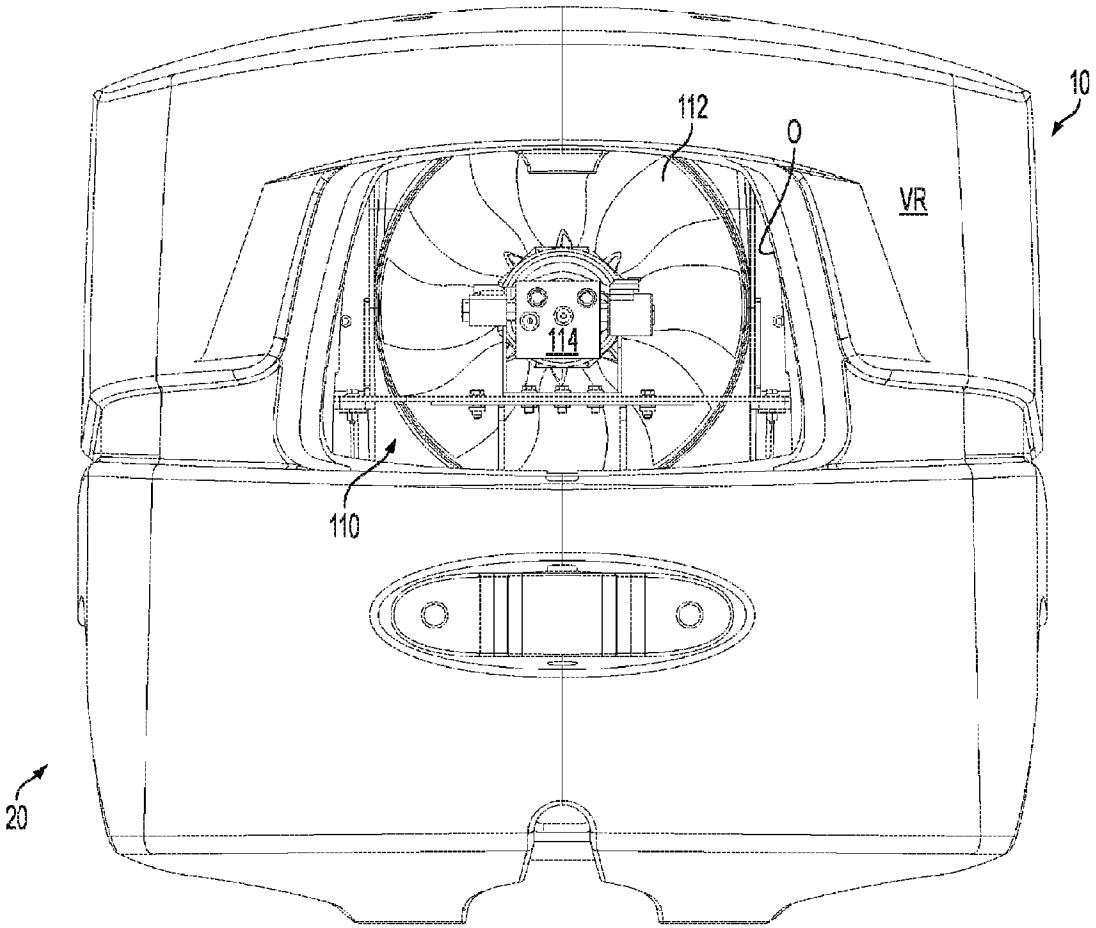
FIG. 5 is a rear view of a portion of the vehicle illustrated in FIG. 1.

The fan apparatus 110 comprises a rotatable fan 112 and a motor 114. The motor 114 comprises a hydraulic motor in the illustrated embodiment, but may comprise an electric motor. During normal operation of the vehicle 10, the motor 114 effects rotation of the fan 112 in a first direction to pull air from inside the engine compartment 22, see direction arrow A in FIG. 6, through the cooling assembly 120, then through an opening O in the rear $V_R$ of the vehicle 10, see FIG. 5. As the air passes through the cooling assembly 120, it removes energy in the form of heat from a coolant fluid that circulates through the engine 23 and the cooling assembly 120. The motor speed may vary with a temperature of the coolant fluid. Preferably, the fan motor 114 is capable of reversing direction, such as when the vehicle 10 is first started or at any desired time, to effect rotation of the fan 112 in a second direction, opposite to the first direction, to force air through a filter element 130 forming part of the cooling assembly 120, to force debris off of the filter element 130.

In the illustrated embodiment, the cooling assembly 120 comprises a heat exchanger 140, e.g., a radiator, and a filter structure 150, see FIG. 2. Appropriate hoses 220, see FIG. 1, extend between the engine 23 and the heat exchanger 140 to allow the coolant fluid to flow between the engine 23 and the cooling assembly 120. The heat exchanger 140 transfers energy in the form of heat from the coolant fluid circulating through the engine 23 to air forced through the heat exchanger 140 by the fan apparatus 110.

Figure 8:
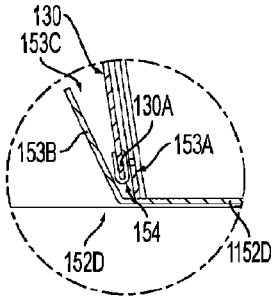
FIG. 8 is an enlarged cross sectional view of a recess formed in the support frame illustrated in FIG. 6.

In the illustrated embodiment, the filter structure 150 comprises a support frame 152, the filter element 130, and a filter element seal structure 154 (also referred to herein as a third seal structure), see FIGS. 2-4. The filter element seal structure 154 is positioned about an outer periphery of the filter element 130 and held thereon via a friction fit or a conventional adhesive. The filter element seal structure 154 may be formed from closed cell foam. The support frame 152 comprises first and second side sections 152A and 152B and upper and lower sections 152C and 152D, see FIG. 3. The first and second side sections 152A, 152B and the upper and lower sections 152C, 152D define a passage 152E through the support frame 152. The lower section 152D comprises a first wall 153A that extends upward from about 10 mm to about 15 mm from a lower wall 1152D of the lower section 152D, see FIG. 8. The first wall 153A further extends along generally the entire length of the lower section 152D. The lower section 152D further comprises a second wall 153B that extends at an angle away from the first wall 153A. The first and second walls 153A and 153B define a recess or pocket 153C for receiving a lower portion 130A of the filter element 130, see FIGS. 6 and 8. The seal structure 154 seals the outer periphery of the filter element 130 to the support frame 152 so as to prevent air, dirt and debris from passing through an interface between the filter element 130 and the support frame 152 and bypassing the filter element 130. The filter element 130 may comprise a metal or polymeric mesh screen, a filter media or a combination of a mesh screen and a filter media.

Figure 6:
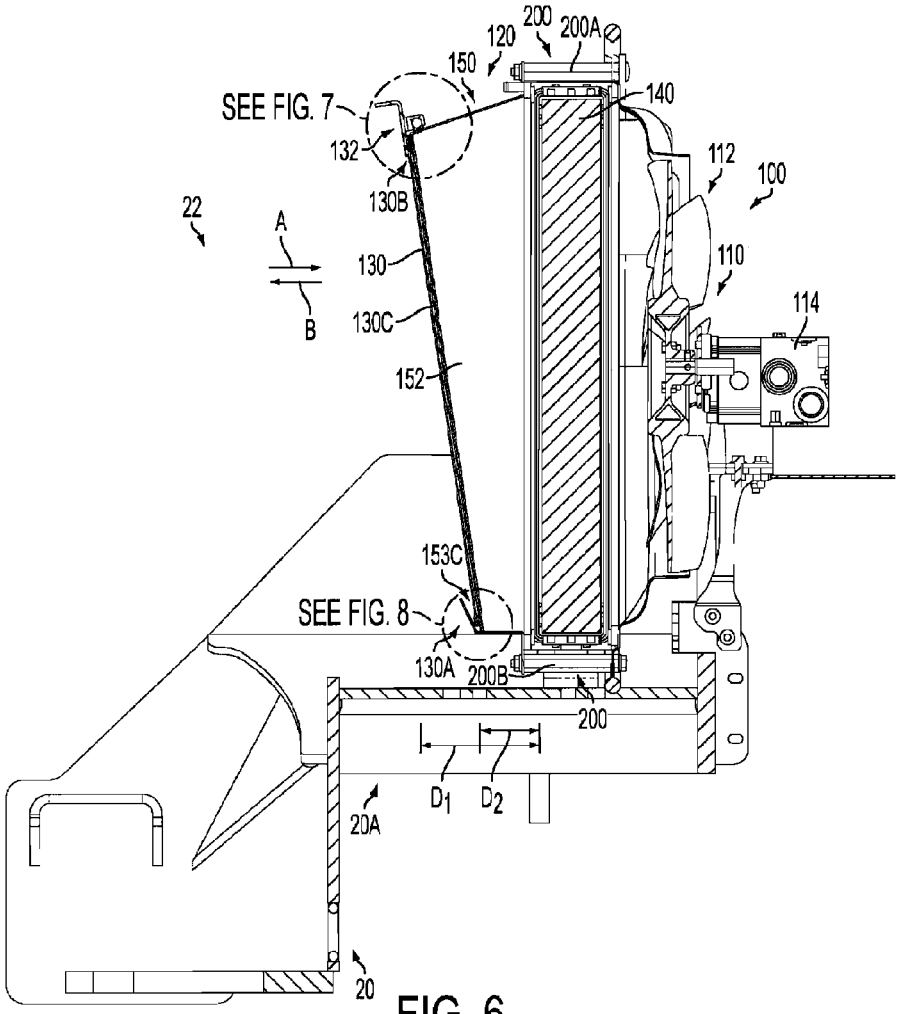
FIG. 6 is a side view in cross section of the cooling system and a portion of a vehicle main frame.
Figure 7:
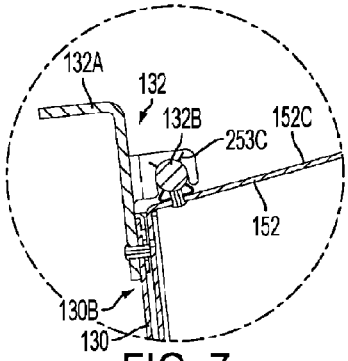
FIG. 7 is an enlarged cross sectional view of the handle structure illustrated in FIG. 6.
Figure 11:
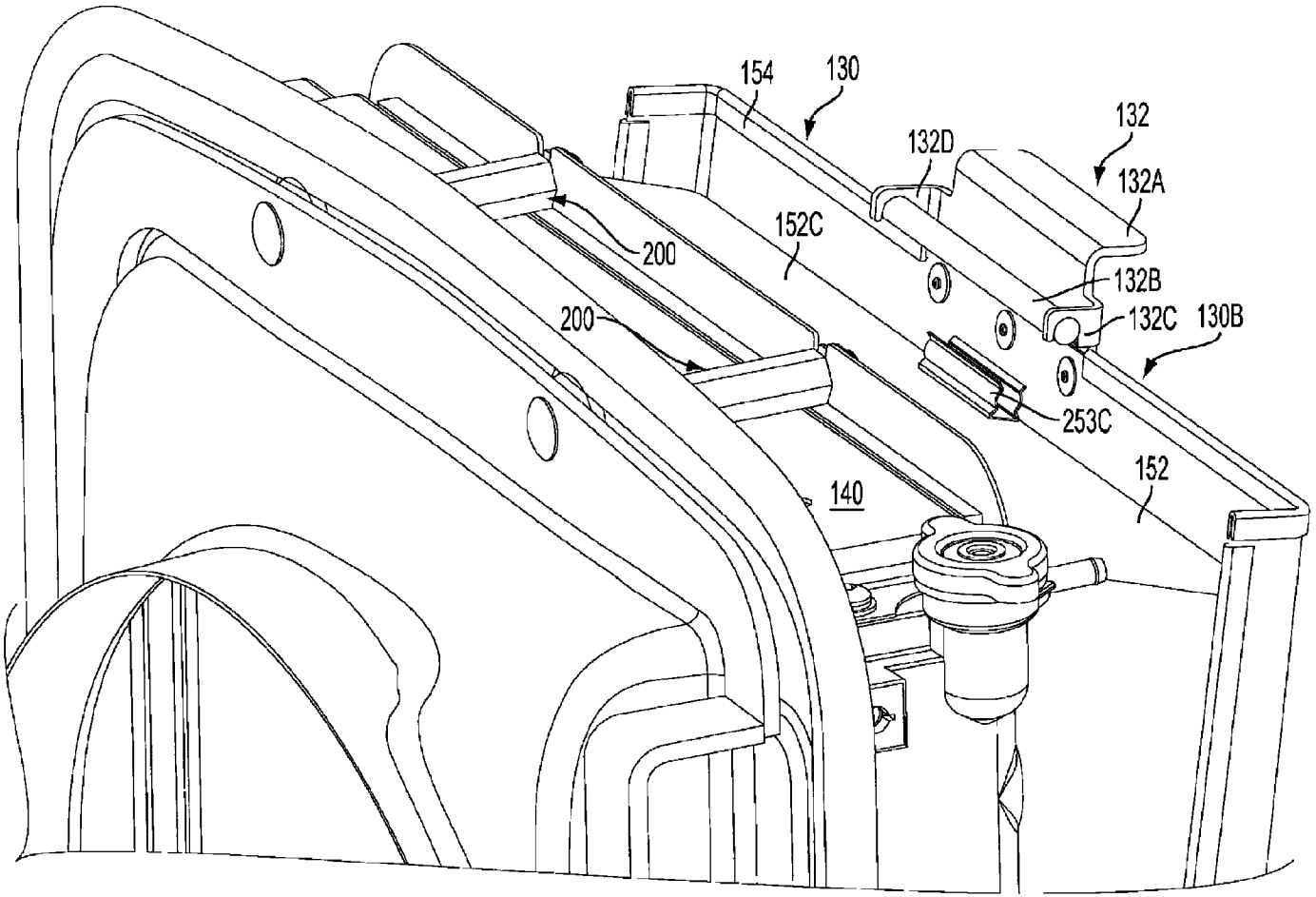
FIG. 11 is a perspective view illustrating the handle structure pin just before engaging the U-shaped spring clip.

A handle structure 132 is bolted, riveted or otherwise coupled to an upper portion 130B of the filter element 130, see FIGS. 6, 7 and 11. In the illustrated embodiment, the handle structure 132 does not move or pivot relative to the filter element upper portion 130B. The handle structure 132 comprises a generally L-shaped gripping portion 132A and a pin 132B extending between extensions 132C and 132D of the gripping portion 132A, see FIGS. 7 and 11. A U-shaped spring clip 253C is coupled to the upper section 152C of the support frame 152, see FIG. 11, for receiving the pin 132B so as to secure the filter element 130 to the support frame 152. To attach the filter element 130 to the support frame 152, the filter element lower portion 130A is inserted into the recess 153C defined in the lower section 152D of the support frame 152 while the pin 132B of the handle structure 132 is aligned with and inserted into the U-shaped spring clip 253C. Once the filter element lower portion 130A is fully seated in the recess 153C and the handle structure pin 132B is received in the spring clip 253C on the support frame upper section 152C, the filter element 130 is attached to the support frame 152. An operator can remove the filter element 130 from the support frame 152 by pulling up on the gripping portion 132A so as to disengage the pin 132B from the spring clip 253C.

In the illustrated embodiment, the support frame 152 is shaped/configured so that when the filter element 130 is attached to the support frame 152, the filter element 130 is positioned at an angle to vertical, e.g., from about 5 degrees to about 10 degrees and preferably about 7 degrees to vertical. More specifically, the upper portion 130B of the filter element 130 is spaced a first distance $D_1$ away from the heat exchanger 140 and the lower portion 130A of the filter element 130 is spaced a second distance $D_2$ away from the heat exchanger 140, with the first distance being greater than the second distance, see FIG. 6. Hence, the filter element 130 is angled downward such that an outer face 130C of the filter element 130 is facing downward towards a surface S over which the truck 10 travels, see FIGS. 1 and 6. Consequently, when the fan motor 114 reverses its direction to effect rotation of the fan 112 in the second direction, air from outside of the truck 10 is force through the cooling assembly 120, see direction arrow B in FIGS. 1 and 6, to force debris off of the filter element 130. Because the filter element 130 is angled downward, it is believed that gravity provides some assistance to the air in forcing debris from the filter element 130 and also causes the debris to fall down onto the surface S. Further, the support frame 152, due to its configuration, causes air passing through the filter element 130 and debris forced off the filter element 130 to be directed downward towards the surface S.

The cooling assembly 120 further comprises a first seal structure 160, a second seal structure 170 and a fan shroud 180, see FIG. 3. The first seal structure 160 may comprise a plurality of first seal strips 160A formed from closed cell foam. The seal strips 160A are positioned between peripheral surfaces 152A and 140A of the support frame 152 and the heat exchanger 140, respectively, to seal an interface between the support frame 152 and the heat exchanger 140, see FIGS. 2, 9 and 10. The seal strips 160A may be frictionally held between the support frame 152 and the heat exchanger 140 or adhesively secured to one or both of the support frame 152 and the heat exchanger 140.

The second seal structure 170 may comprise a seal strip 170A formed from closed cell foam. The seal strip 170A is positioned between peripheral surfaces 140B and 180A of the heat exchanger 140 and the fan shroud 180, respectively, to seal an interface between the heat exchanger 140 and the fan shroud 180, see FIGS. 9 and 10. The seal strip 170A may be frictionally held between the heat exchanger 140 and the fan shroud 180 or adhesively secured to one or both of the heat exchanger 140 and the fan shroud 180.

Figure 9:
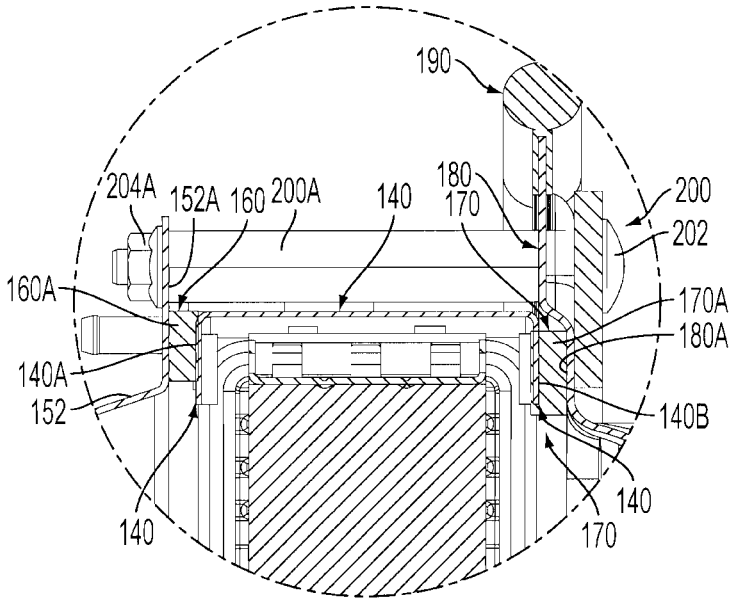
FIGS. 9 and 10 are enlarged cross sectional views illustrating the first and second seal structures and the connecting structure shown in FIG. 6.
Figure 10:
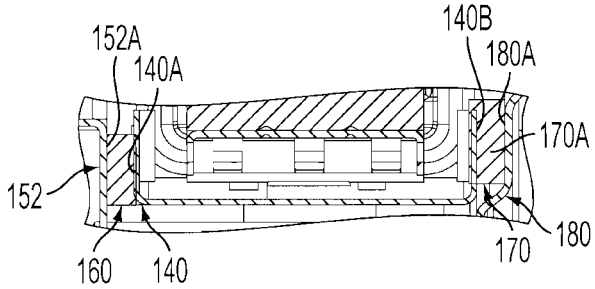

The cooling assembly 120 also comprises connecting structure 200 to couple together the filter structure 150, the first and second seal structures 160 and 170, the heat exchanger 140 and the fan shroud 180, see FIGS. 3, 6 and 9. In the illustrated embodiment, the connecting structure 200 comprises first and second upper spacers 200A, first and second lower spacers 200B and corresponding bolts 202 that pass through bores in the spacers 200A and 200B, see FIGS. 3, 6 and 9. The bolts 202 also extend through corresponding bores or recesses 152F and 180A in the support frame 152 and the fan shroud 180, see FIG. 3. The spacers 200A and 200B are located between the support frame 152 and the fan shroud 180, see FIG. 3. Corresponding nuts 204A engage with the bolts 202 such that the connecting structure 200 secures the filter structure 150, the first and second seal structures 160 and 170, the heat exchanger 140 and the fan shroud 180 together as a single assembly. The cooling assembly 120 may be assembled outside of the vehicle main frame 20 and, once assembled, then installed into the vehicle main frame 20.

The cooling assembly 120 may still further comprise a main frame seal structure 190, see FIGS. 2 and 3, located between the fan shroud 180 and the vehicle main frame 20. The main frame seal structure 190 may comprise a plurality of seal strips 190A formed from ethylene propylene diene M-class rubber (EPDM) bulb edge seal, which is commercially available from PPR Industries. The seal strips 190A are positioned between the outer periphery 180A of the fan shroud 180 and an engagement surface (not shown) on the vehicle main frame 20 to seal an interface between the fan shroud 180 and the vehicle main frame engagement surface. The seal strips 190A may be frictionally held between the fan shroud 180 and the vehicle main frame engagement surface or adhesively secured to one or both of the fan shroud 180 and the vehicle main frame engagement surface. The seal strips 190A prevent air being expelled by the fan 112 from passing back into the engine compartment 22 between the fan shroud 180 and the vehicle main frame 20 and then, once again, through the heat exchanger 140. Heated air re-circulated through the heat exchanger 140 reduces the efficiency of the heat exchanger 140.

Having described the invention in detail and by reference to preferred embodiments thereof, it will be apparent that modifications and variations are possible without departing from the scope of the invention defined in the appended claims.

What is claimed is:

1. A work vehicle comprising:

a main frame including an engine compartment;

an engine located in said engine compartment; and a cooling system for removing energy in the form of heat from said engine and transferring that energy to air, said cooling system comprising:

a rotating fan apparatus comprising a fan and a motor; and a cooling assembly comprising:

a heat exchanger for transferring energy in the form of heat from a coolant fluid circulating through said engine to air forced through said heat exchanger by said fan apparatus; and filter structure positioned adjacent a first side of said heat exchanger to filter the air before the air passes through said heat exchanger, said filter structure comprising a support frame and at least one filter element held by said support frame, said support frame maintains said filter element at an angle relative to vertical;

wherein said motor effects rotation of said fan in a first direction to pull air from said engine compartment through said filter structure and then through said heat exchanger to remove heat from the coolant fluid.

2. The work vehicle as set out in claim 1, wherein said filter element comprises a mesh screen.

3. The work vehicle as set out in claim 1, wherein an upper portion of said filter element is spaced a first distance away from said heat exchanger and a lower portion of said filter element is spaced a second distance away from said heat exchanger, said first distance being greater than said second distance.

4. The work vehicle as set out in claim 1, wherein said motor is capable of reversing direction so as to effect rotation of said fan in a second direction to force air through said filter element to force debris off of said filter element.

5. A cooling assembly and rotating fan apparatus for use in a work vehicle including the rotating fan apparatus comprising a fan and a motor, the cooling assembly comprising:

a heat exchanger for transferring energy in the form of heat from a coolant fluid to air passing through said heat exchanger;

filter structure positioned adjacent a first side of said heat exchanger to filter the air before the air passes through said heat exchanger;

first seal structure located between said filter structure and said heat exchanger to seal an interface between said filter structure and said heat exchanger;

a fan shroud associated with the rotating fan apparatus and positioned adjacent a second side of said heat exchanger; and a second seal structure located between said heat exchanger and said fan shroud;

wherein the motor of the rotating fan apparatus effects rotation of the fan in a first direction to pull air from an engine compartment that includes an engine of the work vehicle through said filter structure and then through said heat exchanger to remove heat from the coolant fluid.

6. The cooling assembly as set out in claim 5, further comprising connecting structure to couple together said filter structure, said first seal structure, said heat exchanger, said fan shroud and said second seal structure.

7. The cooling assembly as set out in claim 6, wherein said connecting structure comprises at least one spacer provided with a bore, a bolt passing through said spacer bore and a nut, said bolt extending through corresponding bores in said filter structure and said fan shroud while said spacer is located between said filter structure and said fan shroud.

8. The cooling assembly as set out in claim 5, wherein said filter structure comprises a support frame and at least one filter element held by said support frame.

9. The cooling assembly as set out in claim 8, wherein said filter element comprises a mesh screen.

10. The cooling assembly as set out in claim 9, wherein said support frame maintains said filter element at an angle relative to vertical.

11. The cooling assembly as set out in claim 10, wherein an upper portion of said filter element is spaced a first distance away from said heat exchanger and a lower portion of said filter element is spaced a second distance away from said heat exchanger, said first distance being greater than said second distance.

12. The cooling assembly as set out in claim 8, wherein said filter structure further comprises a third seal structure located between said support frame and said filter element.

13. The cooling assembly as set out in claim 5, further comprising a main frame seal structure adapted to be located between said fan shroud and a main frame of the work vehicle.

14. A work vehicle comprising:

a main frame including an engine compartment;

an engine located in said engine compartment; and a cooling system for removing energy in the form of heat from said engine and transferring that energy to air, said cooling system comprising:

a rotating fan apparatus comprising a fan and a motor; and a cooling assembly comprising:

a heat exchanger for transferring energy in the form of heat from a coolant fluid circulating through said engine to air forced through said heat exchanger by said fan apparatus;

filter structure positioned adjacent a first side of said heat exchanger to filter the air before the air passes through the heat exchanger;

first seal structure located between said filter structure and said heat exchanger to seal an interface between said filter structure and said heat exchanger;

a fan shroud positioned adjacent a second side of said heat exchanger; and a second seal structure located between said heat exchanger and said fan shroud;

wherein said motor effects rotation of said fan in a first direction to pull air from said engine compartment through said filter structure and then through said heat exchanger to remove heat from the coolant fluid.

15. The work vehicle as set out in claim 14, wherein said cooling assembly further comprises connecting structure to couple together said filter structure, said first seal structure, said heat exchanger, said fan shroud and said second seal structure.

16. The work vehicle as set out in claim 15, wherein said connecting structure comprises at least one spacer provided with a bore, a bolt passing through said spacer bore and a nut, said bolt extending through corresponding bores in said filter structure and said fan shroud while said spacer is located between said filter structure and said fan shroud.

17. The work vehicle as set out in claim 14, wherein said cooling assembly further comprises a main frame seal structure located between said fan shroud and said main frame.

18. The work vehicle as set out in claim 14, wherein said filter structure comprises a support frame and at least one filter element held by said support frame.

19. The work vehicle as set out in claim 18, wherein said support frame maintains said filter element at an angle relative to vertical.

* * * * *